US008317554B1

(12) United States Patent
Williams

(10) Patent No.: US 8,317,554 B1
(45) Date of Patent: Nov. 27, 2012

(54) MODULAR HYDRAULIC THRUSTER SYSTEM FOR VESSEL

(76) Inventor: John T. Williams, Deland, FL (US)

( * ) Notice: Subject to any disclaimer, the term of this patent is extended or adjusted under 35 U.S.C. 154(b) by 180 days.

(21) Appl. No.: 12/800,026

(22) Filed: May 6, 2010

Related U.S. Application Data

(63) Continuation-in-part of application No. 12/381,245, filed on Mar. 10, 2009, now Pat. No. 7,883,384, which is a continuation-in-part of application No. 11/999,531, filed on Dec. 6, 2007, now Pat. No. 7,654,875.

(60) Provisional application No. 60/903,400, filed on Feb. 26, 2007.

(51) Int. Cl.
*B63H 21/12* (2006.01)

(52) U.S. Cl. ..... 440/5; 114/151

(58) Field of Classification Search ..... 114/151, 114/150; 440/5, 4, 6, 61 A, 61 R
See application file for complete search history.

(56) References Cited

U.S. PATENT DOCUMENTS

| | | | | |
|---|---|---|---|---|
| 583,740 | A | 6/1897 | Fryer | |
| 2,486,049 | A | 10/1949 | Miller | |
| 2,766,715 | A | 10/1956 | Waterval | |
| 2,936,730 | A | 5/1960 | Patty, Jr. | |
| 3,010,424 | A | 11/1961 | Peterson et al. | |
| 3,139,062 | A | 6/1964 | Keefe | |
| 4,358,280 | A | 11/1982 | Jeanson et al. | |
| 4,645,463 | A | 2/1987 | Arneson | |
| 4,848,702 | A | 7/1989 | Riggins | |
| 4,878,864 | A | 11/1989 | Van Bentem | |
| 5,249,378 | A | 10/1993 | Frame | |
| 5,476,400 | A | 12/1995 | Theophanides | |
| 6,234,854 | B1 | 5/2001 | Rydzewski | |
| 6,375,524 | B1 | 4/2002 | Commandeur et al. | |
| 6,409,556 | B1 | 6/2002 | Vance | |
| 6,672,236 | B1 | 1/2004 | Pinsof | |
| 6,799,528 | B1 | 10/2004 | Bekker | |
| 6,814,636 | B2 | 11/2004 | Nolen | |
| 7,654,875 | B1 * | 2/2010 | Williams | 440/5 |
| 7,883,384 | B1 * | 2/2011 | Williams | 440/5 |
| 8,007,328 | B2 * | 8/2011 | Williams | 440/5 |
| 2007/0087638 | A1 | 4/2007 | Dulgur | |

OTHER PUBLICATIONS

Jan. 8, 2010, Dynamic Sealing Technologies Inc. Dwg. No. HY-08405.
May 6, 2010, Parker Cat. HY08-1137-3/NA pp. 2, 15.
May 6, 2010, BEI Duncan Electronics 9360 Series Rotary Hall Effect Sensor descriptive bulletin.
May 6, 2010, Balluff BTL6-A500/B50 User's Guide pp. 1-3.
May 6, 2010, Electro-Sensors 906/906B and 907/907B Hall Effect Sensors descriptive bulletin.
May 6, 2010, Electro-Sensors Pulser Wraps descriptive bulletin.

* cited by examiner

*Primary Examiner* — Lars A Olson
(74) *Attorney, Agent, or Firm* — Paul S. Rooy PA

(57) ABSTRACT

A modular hydraulic thruster system for vessel. At least one thruster is hydraulically connected to a power pack and electrically connected to an instrument panel. The instrument panel has a thrust angle indicator, tube gear clamp status indicator, extension indicator, tilt angle indicator, and tachometer, all pertaining to each thruster. The thruster includes a tube rotating and reciprocating through a housing, which is rotatably attached to a bracket. A swivel union is attached to one end of the tube; a hydraulic motor drives a propeller to an opposite end of the tube. Some instrumentation electrical and hydraulic lines are routed through the swivel union and into the tube; others are further routed out of the tube through a tube aperture and through a flexible spiral conduit to accommodate tube reciprocation within the housing. Means is disclosed to prevent a swivel union stationary section from rotating relative to the housing.

22 Claims, 5 Drawing Sheets

MODULAR HYDRAULIC THRUSTER SYSTEM FOR VESSEL

CLAIM FOR PRIORITY

This utility patent application is a Continuation-In-Part of U.S. application Ser. No. 12/381,245 filed Mar. 10, 2009 entitled now U.S. Pat. No. 7,883,384 Self-Contained Hydraulic Thruster for Vessel, which is a Continuation-In-Part of U.S. application Ser. No. 11/999,531 filed Dec. 6, 2007 now U.S. Pat. No. 7,654,875 entitled Self-Contained Hydraulic Thruster for Vessel, which was based upon U.S. provisional patent application Ser. No. 60/903,400 filed Feb. 26, 2007 entitled Modular Hydraulic Thruster System for Vessel; and claims the benefit of the earlier filing date of these applications.

BACKGROUND OF THE INVENTION

1. Field of the Invention

This invention relates to vessel propulsion systems, and in particular to a modular hydraulic thruster system for vessel.

2. Background of the Invention

Marine thrusters typically mount on barges and flat boats, and are used as propulsion for these vessels. One type of marine thruster employs a prime mover such as a diesel engine driving a hydraulic pump, together known as a "power pack", and the resultant pressurized hydraulic fluid may be employed to drive a propeller attached to a lower unit.

A number of designs exist for this type of flat boat propulsion system, with attendant problems. One problem is the lack of readily available instrumentation to depict important condition information such as the angle of thrust at which a given thruster is aiming relative to the centerline of the vessel to which it is attached, the power output being developed in terms of propeller revolutions per minute, the tilt angle of the thruster lower unit, the degree of extension or retraction of the thruster lower unit, and the condition of any clamps in the system (open or closed).

Another problem with existing marine thruster designs is the absence of a quick and easy means to add additional thrusters to the system, as required. It would be desirable to provide a modular hydraulic thruster system for vessel which provides the provisions for readily attaching additional thrusters as required for a flat vessel whose weight loading and/or thruster requirements may be changing.

It would also be desirable to provide a modular hydraulic thruster system for vessel which comprises indication capability including displays of the angle of thrust at which a given thruster is aiming relative to the centerline of the vessel to which it is attached, the power output being developed in terms of propeller revolutions per minute, the tilt angle of the thruster lower unit, the degree of extension or retraction of the thruster lower unit, and the condition of any clamps in the system (open or closed).

SUMMARY OF THE INVENTION

Accordingly, it is an object of the present invention to provide a modular hydraulic thruster system for vessel which provides thrust angle information to the pilot. Design features allowing this object to be accomplished include thrust angle detection means to detect a thrust angle of the propeller electrically connected to a thruster angle indicator in an instrument panel. Advantages associated with the accomplishment of this object include increased safety and efficiency of operation.

It is another object of the present invention to provide a modular hydraulic thruster system for vessel which advises the open/closed status of thruster tube gear clamp(s). Design features allowing this object to be accomplished include tube gear clamp OPEN/CLOSED status indication means electrically connected to a tube gear clamp status indicator in an instrument panel. Benefits associated with the accomplishment of this object include greater facility of operation and aid in eliminating errors when extending and retracting the thruster tube.

It is still another object of this invention to provide a modular hydraulic thruster system for vessel which provides effective protection to tube gear clamp hydraulic lines and tube gear clamp wire. Design features enabling the accomplishment of this object include a swivel union whose swivel union rotating section is attached to a tube, and whose swivel union stationary section is prevented from rotating relative to a thruster housing, and flexible spiral conduit slidably encircling the tube from the swivel union to the tube gear clamp. Advantages associated with the realization of this object include the ability to protect tube gear clamp hydraulic and electrical lines, while extending and retracting the tube relative to the housing.

It is another object of the present invention to provide a modular hydraulic thruster system for vessel which provides thrust power information to the pilot. Design features allowing this object to be accomplished include revolutions per minute detection means at a hydraulic motor electrically connected to a tachometer in an instrument panel. Benefits associated with the accomplishment of this object is more precise thruster control, and attendant efficiency of operation increase.

It is still another object of this invention to provide a modular hydraulic thruster system for vessel which provides uninterrupted hydraulic and electric lines continuity to a tube gear clamp and tube lower end, even while changing the angle between the housing and the tube during steering. Design features enabling the accomplishment of this object include a swivel union whose swivel union rotating section is attached to a tube; whose swivel union stationary section is prevented from rotating relative to a thruster housing; close clamp hydraulic line, open clamp hydraulic line, forward thrust hydraulic line, reverse thrust hydraulic line, return hydraulic line, tube gear clamp wire, and tachometer wire passing through the swivel union. Advantages associated with the realization of this object include conversion of hydraulic and electrical lines from stationary to rotating, and the consequent ability to steer the thruster through a 360 degree arc.

It is another object of the present invention to provide a modular hydraulic thruster system for vessel which provides thruster tilt angle to the pilot. Design features allowing this object to be accomplished include angle-of-tilt detection means connected to a tilt actuator, and a tilt angle indicator in an instrument panel. Benefits associated with the accomplishment of this object is more precise operation of a vessel upon which the modular hydraulic thruster system for vessel, with attendant efficiency and safety increases.

It is still another object of this invention to provide a modular hydraulic thruster system for vessel which provides thruster extension information to the pilot. Design features enabling the accomplishment of this, object include a percentage-of-extension detection means connected to an extension actuator, and an extension indicator in an instrument panel. Benefits associated with the accomplishment of this object is more precise operation of a vessel upon which the modular hydraulic thruster system for vessel, with attendant efficiency and safety increases.

It is yet another object of this invention to provide a modular hydraulic thruster system for vessel which is economical to produce. Design features allowing this object to be achieved include the use of commercially available elements, and components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Five sheets of drawings are provided. Sheet one contains FIG. 1. Sheet two contains FIG. 2. Sheet three contains FIG. 3. Sheet four contains FIG. 4. Sheet five contains FIGS. 5 and 6.

DETAILED DESCRIPTION OF THE PREFERRED EMBODIMENT

Figure 1:
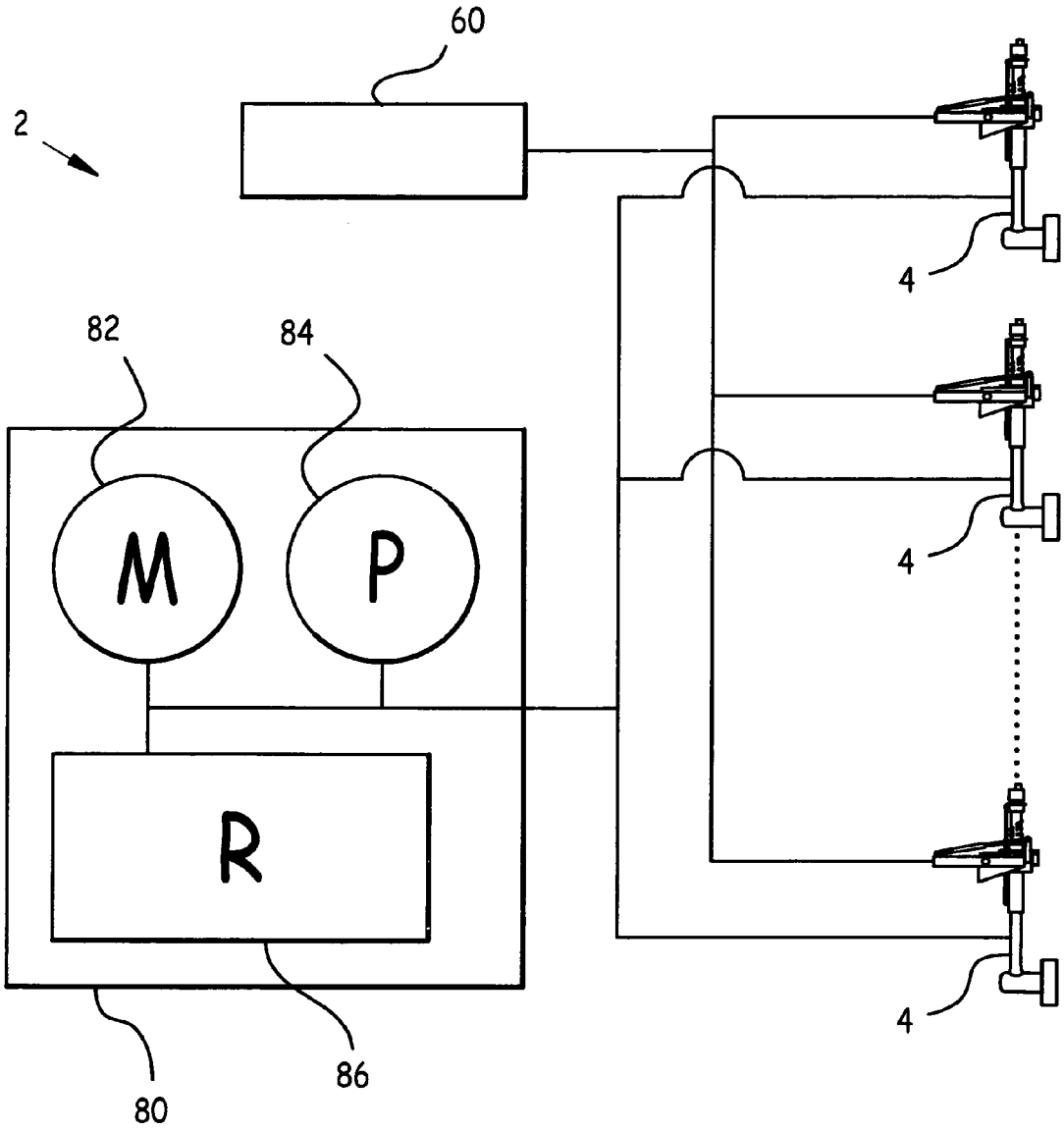
FIG. 1 is a schematic diagram of the instant modular hydraulic thruster system for vessel 2.

FIG. 1 is a schematic diagram of the instant modular hydraulic thruster system for vessel 2. Referring to this figure, modular hydraulic thruster system for vessel 2 comprises power pack 80, instrument panel 60, and at least one thruster 4 electrically and/or hydraulically connected to instrument panel 60 and power pack 80. As may be observed in FIG. 1, any number of thrusters 4 may be connected to instrument panel 60 and power pack 80, depending on the needs of the individual vessel upon which modular hydraulic thruster system for vessel 2 is installed.

Power pack 80 comprises prime mover 82, pump 84, and reservoir 86. In the preferred embodiment, prime mover 82 was a diesel or internal combustion engine, pump 84 was a hydraulic pump driven by prime mover 82, and reservoir 86 contained hydraulic fluid pumped by pump 84, as driven by prime mover 82.

Instrument panel 60 contains instrumentation to continuously communicate information and status including displays of the angle of thrust at which a given thruster 4 is aiming relative to the centerline of the vessel to which it is attached, the power output being developed in terms of propeller revolutions per minute, the tilt angle of the thruster lower unit, the degree of extension or retraction of the thruster tube 6, and the condition of any clamps in the system (open or closed). The instant apparatus associated with these functions will be explained more fully below.

One or more thrusters 4 may be connected to instrument panel 60 and power pack 80, depending on the thruster power requirements of a specific vessel. In the preferred embodiment, thrusters 4 were hydraulic thrusters, and each thruster 4 was hydraulically connected with power pack 80, and electrically connected to instrument panel 60.

Figure 2:
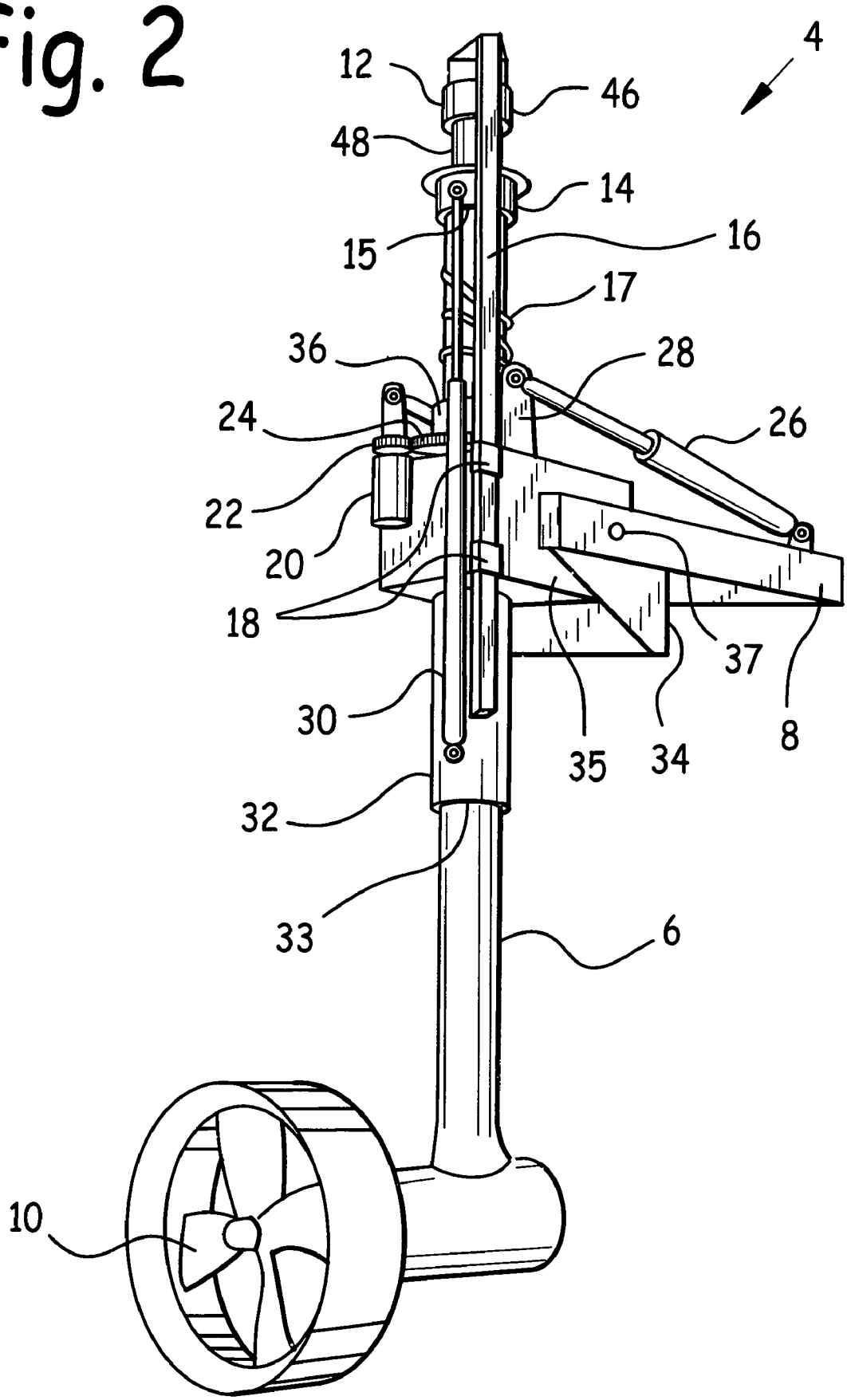
FIG. 2 is a right front quarter isometric view of a thruster.
Figure 3:
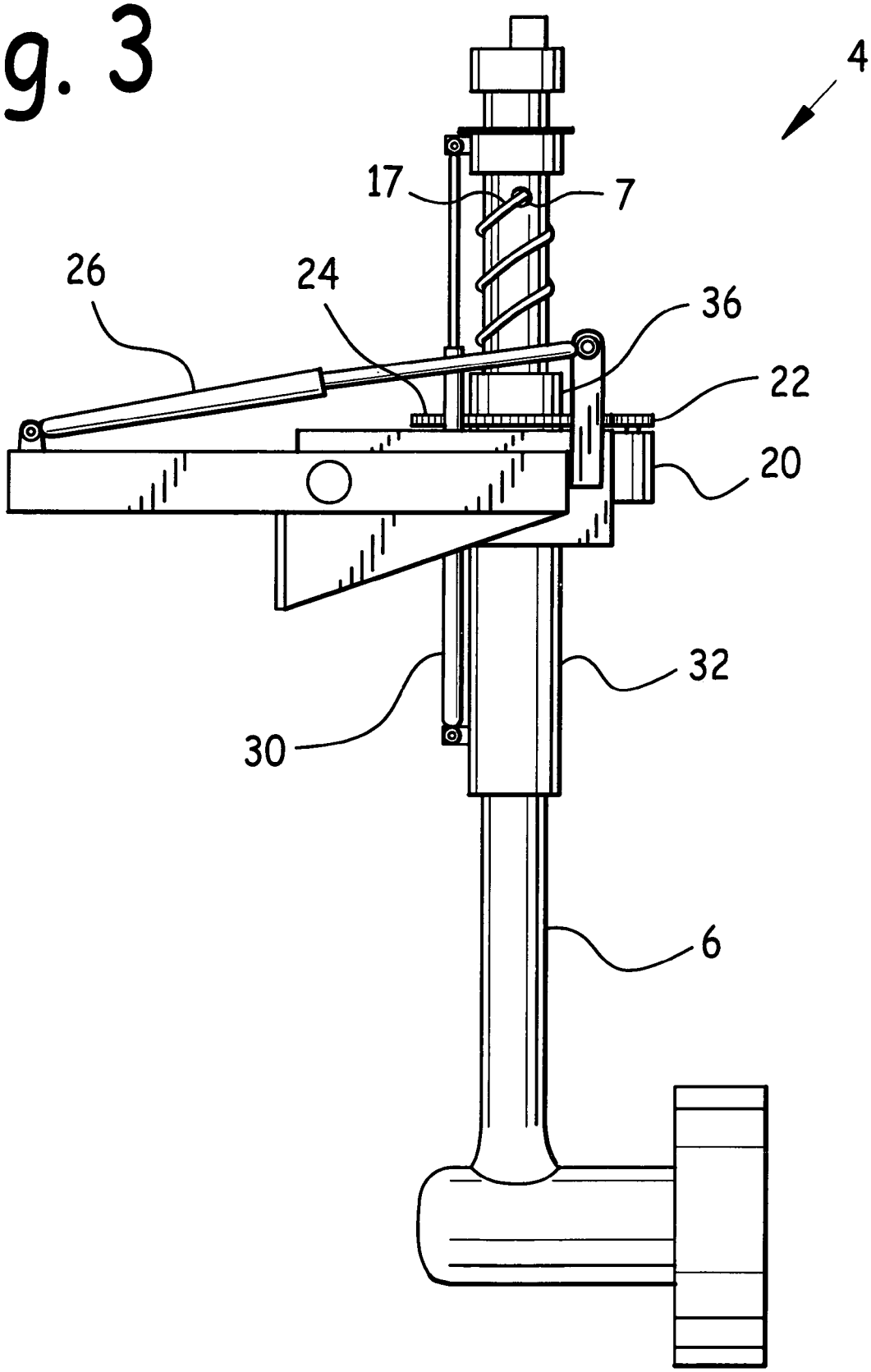
FIG. 3 is a left side view of a thruster.

FIG. 2 is a right front quarter isometric view of thruster 4. FIG. 3 is a left side view of thruster 4. As may be observed in these figures, thruster 4 is made up of tube 6 rotating and reciprocating within cylinder 32, which is rigidly attached to housing 35. Propeller 10 is disposed at a lower end of tube 6. In the preferred embodiment, a length of cylinder 32 was substantially 38%±10% the length of tube 6.

Housing 35 is rotatably attached to bracket 8 at pivot points 37. In use, bracket 8 is rigidly attached to a vessel, and serves as the attachment point for thruster 4 to a vessel upon which thruster 4 is mounted. Stop 34 is rigidly attached to, and extends downwards from, bracket 8. Stop 34 butts up against the stern of the vessel, and provides a positive mechanical stop for thruster 4 to exert forward force against the vessel.

At least one tilt actuator arm 28 extends upwards from housing 35. One end of tilt actuator 26 is rotatably attached to an end of an associated tilt actuator arm 28; an opposite end of tilt actuator 26 is rotatably attached to an end of bracket 8 opposite housing 36. Retraction and extension of tilt actuator 26 causes housing 35 to rotate upwards around pivot points 37, and downwards around pivot points 37, respectively.

Figure 6:
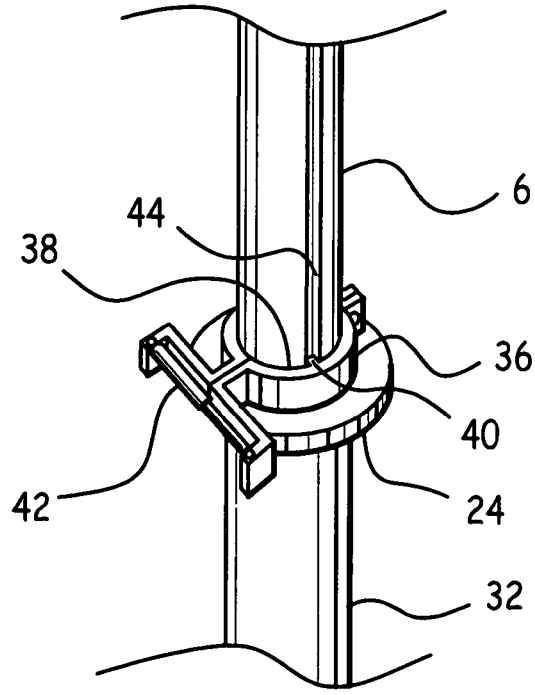
FIG. 6 is an elevated quarter isometric view of a steering clamp.

Tube 6 is sized to slidably fit into cylinder bore 33 in cylinder 32. Thus, tube 6 is free to rotate and reciprocate within cylinder 32. Referring now also to FIG. 6, an elevated quarter isometric view of steering gear clamp 36, we observe that reversible steering motor 20 drives steering motor gear 22, which in turn drives tube gear 24. Tube gear 24 is rigidly attached to tube gear clamp 36, and steering motor 20 is rigidly attached to housing 35.

Tube gear clamp 36 contains tube gear clamp bore 38, which is sized to slidably admit tube 6. Tube gear clamp key 40 extends into tube gear clamp bore 38, and is sized to slidably reciprocate within tube keyway 44 in tube 6. Tube gear clamp key 40 reciprocating within tube keyway 44 prevents tube 6 from rotating relative to tube gear clamp 36 and tube gear 24. Thus, when steering motor 20 turns tube gear 24 and rigidly attached tube gear clamp 36, tube 6 turns at the same rate, thus providing a steering function to thruster 4.

Tube gear clamp 36 further comprises tube gear clamp actuator 42, which loosens and tightens tube gear clamp 36 on tube 6. Tube gear clamp 36 must be loosened, or opened, prior to extending or retracting tube 6 within cylinder 32, and tube gear clamp actuator 42 permits opening and closing of tube gear clamp 26 to be accomplished remotely.

Given that tube gear clamp 36 must be opened prior to extending or retracting tube 6 within cylinder 32, and closed thereafter, it is important to provide a tube gear clamp 36 condition indication (OPEN or CLOSED) at instrument panel 60, as explained below.

Following extension or retraction of tube 6, tube gear clamp 36 must be closed or tightened, in order to prevent tube 6 from rotating within tube gear clamp 36 while steering.

Thruster 4 also has at least one extension actuator 30 which permits tube 6 to be extended and retracted relative to cylinder 32. Extension actuator 30 is attached at its lower end to cylinder 32, and at its upper end to collar 14. Collar 14 has collar bore 15 sized to slidably admit tube 6.

Swivel union 12 having an upper swivel union stationary section 46 rotatably attached to a lower swivel union rotating section 48 is disposed atop tube 6. Swivel union rotating section 48 is attached to the top of tube 6, and rotates with tube 6. Swivel union stationary section 46 is prevented from rotating by means of anti-rotation member 16, an upper end of which is rigidly attached to swivel union stationary section 46. Swivel union 12 includes electronic angle detection means to determine and transmit to instrument panel 60 via electrical signal the angle between swivel union stationary section 46 and swivel union rotating section 48.

Anti-rotation member 16 is maintained in constant vertical orientation relative to housing 35 by means of antirotation member guide(s) 18 rigidly attached to housing 35. Each anti-rotation guide 18 is sized to slidably admit anti-rotation member 16. In the preferred embodiment, one anti-rotation member guide 18 was rigidly attached at an upper edge of housing 35, and another anti-rotation member guide 18 was rigidly attached at a lower edge of housing 35.

Because anti-rotation member 16 is free to reciprocate within anti-rotation member guides 18 (which are rigidly attached to housing 36), and because an upper end of anti-rotation guide 16 is rigidly attached to swivel union stationary section 46, swivel union 12 is free to rise as urged by collar 15 actuated by extension actuator(s) 30 (while simultaneously being prevented from rotating relative to housing 35 by anti-rotation member 16); and is also free to descend with collar 15 under the influence of gravity when extension actuator(s) 30 are retracted (while simultaneously being prevented from rotating relative to housing 36 by anti-rotation member 16).

Thus, tube 6 is retracted by extension of extension actuator(s) 30, which pushes both collar 15 and swivel union 12 upwards. Tube 6 is extended by retraction of extension actuator(s) 30, which permits both collar 15 and swivel union 12 to descend under the influence of gravity.

Figure 4:
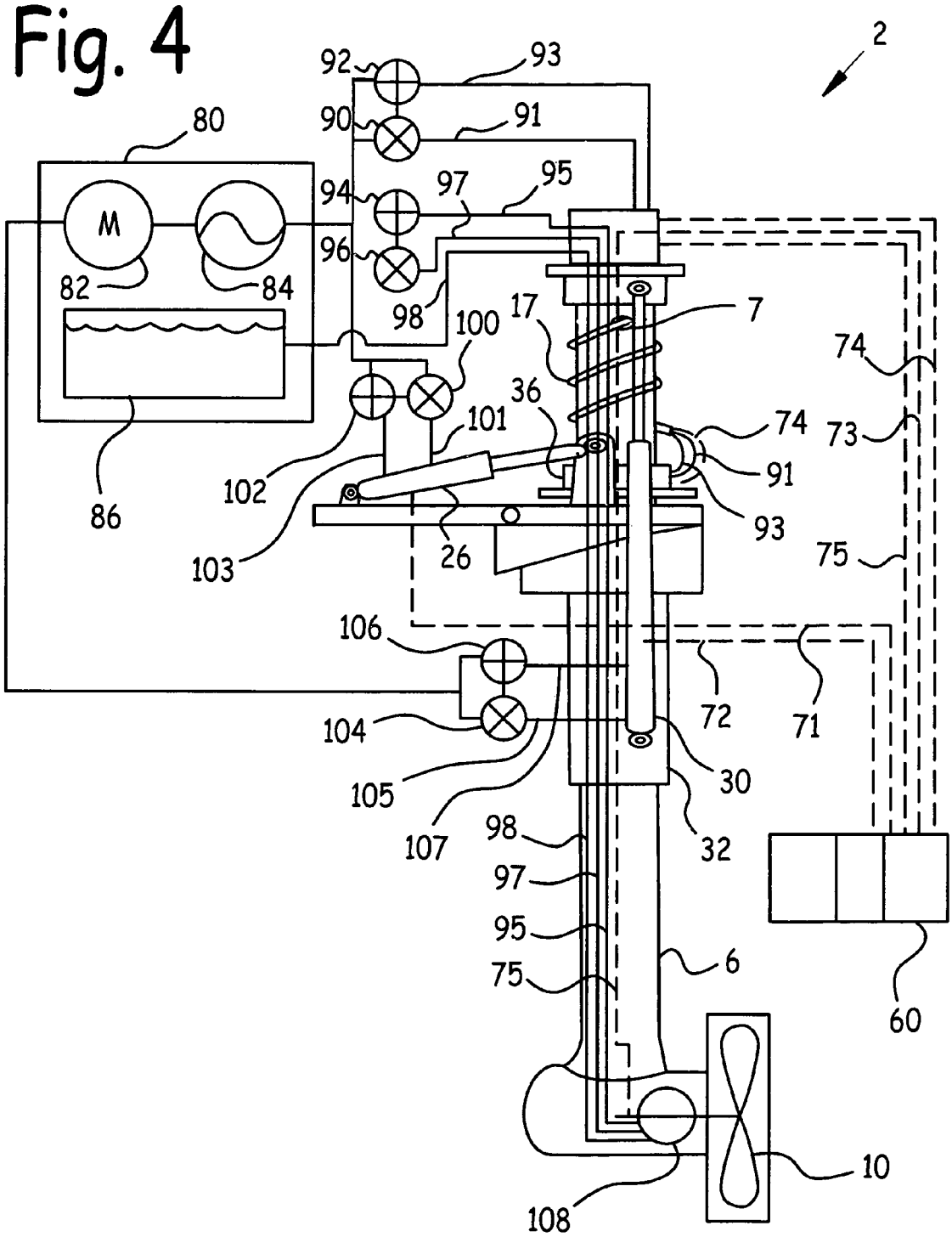
FIG. 4 is a detailed schematic diagram of the instant modular hydraulic thruster system for vessel.
Figure 5:
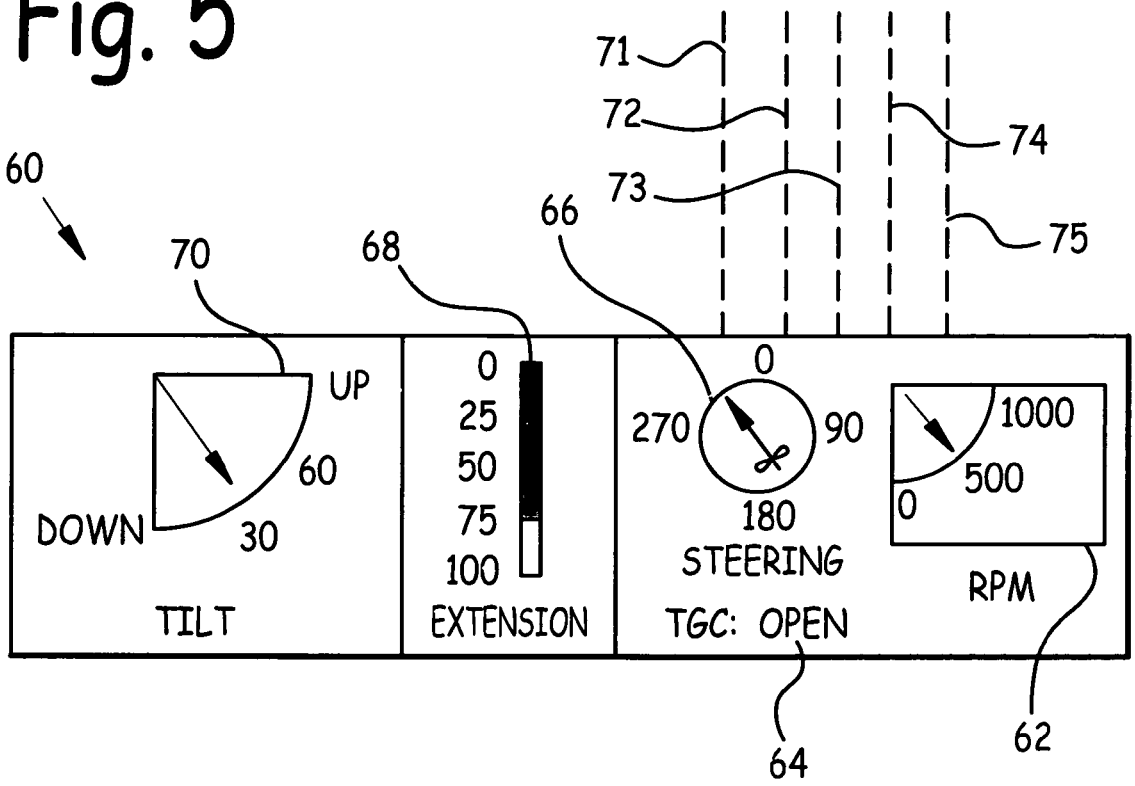
FIG. 5 is a front view of an instrument panel.

FIG. 4 is a detailed schematic diagram of modular hydraulic thruster system for vessel 2. FIG. 5 is a front view of instrument panel 60. As mentioned previously, it is important for the operator of modular hydraulic thruster system for vessel 2 to have current information about the status of various aspects of the system: whether tube gear clamp 36 is OPEN or CLOSED, propeller RPMs (propeller speed in revolutions per minute), thruster tilt status, thruster extension status, and thruster angle relative to vessel centerline.

In the preferred embodiment, propeller 10 turns as urged by reversible hydraulic motor 108 at the bottom end of tube 6. Referring to FIG. 4, when forward thrust is commanded, hydraulic fluid travels under pressure from pump 84, through open forward thrust valve 94 (reverse thrust valve 96 remains closed), and via forward thrust hydraulic line 95 to hydraulic motor 108. Similarly, when reverse thrust is commanded, hydraulic fluid under pressure travels from pump 84, through open reverse thrust valve 96 (forward thrust valve 94 remains closed), and via reverse thrust hydraulic line 97 to hydraulic motor 108. Low pressure hydraulic fluid then returns to reservoir 86 via return hydraulic line 98.

Tube gear clamp 36 opens and closes under hydraulic fluid pressure. When tube gear clamp 36 is commanded to open, hydraulic fluid travels under pressure from pump 84, through open clamp valve 92 (close clamp valve 90 remains closed), and via open clamp hydraulic line 93 to tube gear clamp 36. Similarly, when tube gear clamp 36 is commanded to close, hydraulic fluid travels under pressure from pump 84, through close clamp valve 90 (open clamp valve 92 remains closed), and via close clamp hydraulic line 91 to tube gear clamp 36.

Tube 6 tilts up and down under hydraulic fluid pressure to tilt actuator 26. When tilt actuator 26 is commanded to retract, thereby tilting tube 6 up, hydraulic fluid travels under pressure from pump 84, through tilt up valve 100 (tilt down valve 102 remains closed), and via tilt up hydraulic line 101 to tilt actuator 26. Similarly, when tilt actuator 26 is commanded to extend, thereby tilting tube 6 down, hydraulic fluid travels under pressure from pump 84, through tilt down valve 102 (tilt down valve 100 remains closed), and via tilt down hydraulic line 103 to tilt actuator 26.

Tube 6 extends and retracts under hydraulic fluid pressure to extension actuator 30. When extension actuator 30 is commanded to extend, thereby retracting tube 6, hydraulic fluid travels under pressure from pump 84, through extension valve 104 (retraction valve 106 remains closed), and via extension hydraulic line 105 to extension actuator 30. Similarly, when extension actuator 30 is commanded to retract, thereby extending tube 6, hydraulic fluid travels under pressure from pump 84, through retraction valve 106 (extension valve 104 remains closed), and via retraction hydraulic line 107 to extension actuator 30.

Referring now also to FIG. 5, the important status indications referred to previously in this disclosure is provided by instrument panel 60. Instrument panel 60 includes thrust angle indicator 66, tube gear clamp status indicator 64, extension indicator 68, tilt angle indicator 70, and tachometer 62.

Thrust angle indicator 66 indicates the angle of thrust of propeller 10 relative to the centerline of a vessel upon which modular hydraulic thruster system for vessel 2 is mounted. Swivel union 12 includes electronic angle detection means to determine and transmit to instrument panel 60 via electrical signal the angle between swivel union stationary section 46 and swivel union rotating section 48.

Thruster angle wire 73 carries the resultant electric signal from the swivel union 12 electronic angle detection means to thruster angle indicator 66, whose needle indicates the angle between swivel union stationary section 46 and swivel union rotating section 48, calibrated to indicate zero degrees when the thrust from propeller 10 is aimed directly backwards, aligned with the centerline of the vessel. In FIG. 5, thrust angle indicator 66 shows thrust is at 150 degrees, which is thirty degrees to starboard from directly astern.

Tube gear clamp status indicator 64 indicates whether tube gear clamp 36 is opened or closed. This is important information to have readily available, because as explained above, tube gear clamp 36 must be opened prior to extending or retracting tube 6 within cylinder 32, and closed thereafter. Tube gear clamp 36 includes electronic OPEN/CLOSED status indication means to determine and transmit to instrument panel 10 via electrical signal whether tube gear clamp 36 is opened or closed.

Tube gear clamp wire 74 carries the resultant electrical signal from the tube gear clamp 36 electronic OPEN/CLOSED status indication means to tube gear clamp status indicator 64 in instrument panel 60. Tube gear clamp status indicator 64 then displays the status, e.g. with a light illuminating under indicia, LED display, LCD display, etc.

As may be observed in FIGS. 2, 3, and 4, swivel union 12 must be installed to convert from stationary to rotational the connections for hydraulic motor 108 (forward thrust hydraulic line 95, reverse thrust hydraulic line 97, return hydraulic line 98, and tachometer wire 75); and the connections for tube gear clamp 36 (close clamp hydraulic line 91, open clamp hydraulic line 93, and tube gear clamp wire 74). Swivel union 12 permits the hydraulic lines and electrical lines associated with hydraulic motor 108 and tube gear clamp 36 to be connected to swivel union stationary section 46. The hydraulic lines and electrical line associated with hydraulic motor 108 are then run inside tube 6 from swivel union rotating section 48 to hydraulic motor 108, as depicted in FIG. 4.

An additional complication exits relative to the hydraulic and electrical lines running from swivel union rotating section 48 to tube gear clamp 36. Because tube 6 reciprocates within cylinder 32 as tube 6 extends and retracts, the distance between swivel union rotating section 48 and tube gear clamp 36 may vary considerably. It is therefore necessary to employ a variable-length conduit to carry the hydraulic and electrical lines running from swivel union rotating section 48 to tube gear clamp 36.

The instant design runs close clamp hydraulic line 91, open clamp hydraulic line 93, and tube gear clamp wire 74 through flexible spiral conduit 17 between swivel union rotating section 48 to tube gear clamp 36. Flexible spiral conduit 17 is wrapped several turns around tube 6, and due to its flexibility and spiral shape, can accommodate the full extension/retraction travel of tube 6.

Because close clamp hydraulic line 91, open clamp hydraulic line 93, and tube gear clamp wire 74 are connected to swivel union stationary section 46 inside tube 6, tube aperture 7 sized to admit these permits their egress from the inside of tube 6, and into flexible spiral conduit 17 to tube gear clamp 36. Thus, close clamp hydraulic line 91, open clamp hydraulic line 93, and tube gear clamp wire 74 run from swivel union stationary section 46, through tube aperture 7, through flexible spiral conduit 17, and to tube gear clamp 36.

Extension indicator 68 indicates the percentage extension of tube 6 relative to housing 36. This indication is important, because in brackish or other low-visibility water, the degree of extension of tube 6 cannot be ascertained visually. Extension actuator 30 includes electronic percentage-of-extension detection means to determine and transmit to instrument panel 10 via electrical signal the extent of extension of extension actuator 30. Extension wire 72 carries the resultant electrical signal from the extension actuator 30 electronic percentage-of-extension detection means from extension actuator 30 to extension indicator 68 in instrument panel 60. Extension indicator 68 shows the percentage extension of tube 6 relative to housing 35, and is indicated as being 75% extended in FIG. 5.

Tilt angle indicator 70 indicates the tilt angle of tube 6. This indication is important, because the operator of modular hydraulic thruster system for vessel 2 may be facing forward, and thruster(s) 4 behind such operator may not be readily visible. Tilt actuator 26 includes electronic angle-of-tilt detection means to determine and transmit to instrument panel 60 via electrical signal the extent of extension of tilt actuator 30, which is proportional to the tilt angle of tube 6. Tilt angle wire 71 carries the resultant electrical signal from the tilt actuator 26 electronic angle-of-tilt detection means from tilt actuator 26 to tilt angle indicator 70 in instrument panel 60. Tilt angle indicator 70 shows the angle tilt of tube 6, and is indicated as being thirty degrees up from completely down in FIG. 5.

Tachometer 62 indicates the rotation speed of propeller 10, typically displayed in revolutions per minute. This indication is important, because revolutions per minute of propeller 10 represents the amount of thrust power being developed at propeller 10. Electronic revolutions per minute detection means (such as a rotating magnet on the shaft of propeller 10 and an associated stationary sensor) is disposed in the proximity of hydraulic motor 108 to determine and transmit to instrument panel 10 via electrical signal the speed of propeller 10. Tachometer wire 75 carries the resultant electrical signal from the electronic revolutions per minute detection means to tachometer 62 in instrument panel 60. In FIG. 5, tachometer 62 shows propeller speed at 500 revolutions per minute.

Instrument panel 60 may include thrust angle indicator 66, tube gear clamp status indicator 64, extension indicator 68, tilt angle indicator 70, and tachometer 62 as discrete instruments, as parts of a unified display such as a liquid crystal display or monitor, or any other appropriate display means.

In the preferred embodiment, the structural components of thruster 4 and reservoir 86 were made of metal, synthetic, or other appropriate material. Steering motor 56; swivel union 12; collar 14; tube gear 24; steering motor gear 20; tube gear clamp 36; tilt actuator 26; extension actuator 20; hydraulic motor 108; propeller 10; valves 20, 92, 94, 96, 102, 104, 106 and 108; the hydraulic lines; the electrical lines; flexible spiral conduit 17; extension actuator 30 electronic percentage-of-extension detection means; tilt actuator 26 includes electronic angle-of-tilt detection means; electronic revolutions per minute detection means; and hydraulic power pack 22 were commercially available items.

Instrument panel 60 may include thrust angle indicator 66, tube gear clamp status indicator 64, extension indicator 68, tilt angle indicator 70, and tachometer 62 as discrete instruments, as parts of a unified display such as a liquid crystal display or monitor, or any other appropriate display means.

In the preferred embodiment, tilt actuator 26 and extension actuator 30 were hydraulic actuators powered by pressurized hydraulic fluid from hydraulic power pack 80, although it is intended to fall within the scope of this disclosure that these elements be any appropriate actuator, including but not limited to electrical actuators, solenoids, linear motors, rack-and-pinion gear arrangements, etc. Similarly, in the preferred embodiment steering motor 20 was a hydraulic motor, but it is intended to fall within the scope of this disclosure that this elements be any appropriate motor, including electrical, etc.

While a preferred embodiment of the invention has been illustrated herein, it is to be understood that changes and variations may be made by those skilled in the art without departing from the spirit of the appending claims.

DRAWING ITEM INDEX

2 modular hydraulic thruster system for vessel.
4 thruster
6 tube
7 tube aperture
8 bracket
10 propeller
12 swivel union
14 collar
15 collar bore
16 anti-rotation member
17 flexible spiral conduit
18 anti-rotation member guide
20 steering motor
22 steering motor gear
24 tube gear
26 tilt actuator
28 tilt actuator arm
30 extension actuator
32 cylinder
33 cylinder bore
34 stop
35 housing
36 tube gear clamp
37 pivot point
38 tube gear clamp bore
40 tube gear clamp key
42 tube gear clamp actuator
44 tube keyway
46 rotating union stationary section
48 rotating union rotating section
60 instrument panel
62 tachometer
64 tube gear clamp status indicator
66 thruster angle indicator
68 extension indicator
70 tilt angle indicator
71 tilt angle wire
72 extension wire
73 thruster angle wire
74 tube gear clamp wire
75 tachometer wire

80 power pack
82 prime mover
84 pump
86 reservoir
90 close clamp valve
91 close clamp hydraulic line
92 open clamp valve
93 open clamp hydraulic line
94 forward thrust valve
95 forward thrust hydraulic line
96 reverse thrust valve
97 reverse thrust hydraulic line
98 return hydraulic line
100 tilt up valve
101 tilt up hydraulic line
102 tilt down valve
103 tilt down hydraulic line
104 extension valve
105 extension hydraulic line
106 retraction valve
107 retraction hydraulic line
108 hydraulic motor

I claim:

1. A modular hydraulic thruster system for vessel comprising a hydraulic power pack electrically connected to an instrument panel and hydraulically connected to at least one thruster; said thruster comprising a tube slidably disposed within a housing, a bracket rotatably attached to said housing, a propeller driven by a hydraulic motor at a lower end of said tube, a steering motor rigidly attached to said housing, said steering motor engaged with said tube whereby said steering motor may be used to cause said tube to rotate within said housing, thrust angle detection means to detect a thrust angle of said propeller, and a thruster angle indicator in said instrument panel, said thruster angle indicator being electrically connected to said thrust angle detection means, whereby said thruster angle indicator in said instrument panel displays a thrust angle of said thruster.

2. The modular hydraulic thruster system for vessel of claim 1 further comprising a steering motor gear attached to said steering motor output, said steering motor gear engaging a tube gear rigidly attached to a tube gear clamp around said tube, tube gear clamp OPEN/CLOSED status indication means, and a tube gear clamp status indicator in said instrument panel, said tube gear clamp OPEN/CLOSED status indication means being electrically connected to said tube gear clamp status indicator, whereby said tube gear clamp status indicator in said instrument panel displays an open or closed tube gear clamp status.

3. A modular hydraulic thruster system for vessel comprising a hydraulic power pack electrically connected to an instrument panel and hydraulically connected to at least one thruster; said thruster comprising a tube slidably disposed within a housing, a bracket rotatably attached to said housing, a propeller driven by a hydraulic motor at a lower end of said tube, an extension actuator attached at one end to said housing and at an opposite end to a collar slidably encircling said tube, percentage-of-extension detection means connected to said extension actuator, and an extension indicator in said instrument panel, said percentage-of-extension detection means being electrically connected to said extension indicator, whereby said extension indicator in said instrument panel displays a tube extension percentage.

4. A modular hydraulic thruster system for vessel comprising a hydraulic power pack electrically connected to an instrument panel and hydraulically connected to at least one thruster; said thruster comprising a tube slidably disposed within a housing, a bracket rotatably attached to said housing, a propeller driven by a hydraulic motor at a lower end of said tube, a tilt actuator attached at one end to said bracket and at an opposite end to said housing, angle-of-tilt detection means connected to said tilt actuator, and a tilt angle indicator in said instrument panel, said angle-of-tilt detection means being electrically connected to said tilt angle indicator, whereby said tilt angle indicator in said instrument panel displays a tube tilt angle.

5. A modular hydraulic thruster system for vessel comprising a hydraulic power pack electrically connected to an instrument panel and hydraulically connected to at least one thruster; said thruster comprising a tube slidably disposed within a housing, a bracket rotatably attached to said housing, a propeller driven by a hydraulic motor at a lower end of said tube, revolutions per minute detection means at said hydraulic motor electrically connected to a tachometer in said instrument panel, whereby said tachometer in said instrument panel displays rotational speed of said propeller.

6. A modular hydraulic thruster system for vessel comprising a hydraulic power pack electrically connected to an instrument panel and hydraulically connected to at least one thruster; said thruster comprising a tube slidably disposed within a housing, a bracket rotatably attached to said housing, a propeller driven by a hydraulic motor at a lower end of said tube, a swivel union at an end of said tube opposite said hydraulic motor, said swivel union comprising a swivel union stationary section rotatably attached to a swivel union rotating section rigidly attached to said tube, and means to prevent said swivel union stationary section from rotating relative to said housing comprising an anti-rotation member rigidly attached at one end to said swivel union stationary section and at least one anti-rotation member guide rigidly attached to said housing, each said anti-rotating guide being sized to slidably admit said anti-rotation member, said anti-rotation member being disposed substantially parallel to said tube.

7. The modular hydraulic thruster system for vessel of claim 6 further comprising a cylinder rigidly attached to said housing and running through said housing, said cylinder being sized to slidably admit said tube, said tube being disposed within said cylinder, said tube reciprocating and rotating within said cylinder.

8. The modular hydraulic thruster system for vessel of claim 7 wherein a length of said cylinder is substantially 38%±10% a length of said tube.

9. A modular hydraulic thruster system for vessel comprising a hydraulic power pack electrically connected to an instrument panel and hydraulically connected to at least one thruster; said thruster comprising a tube slidably disposed within a housing, a bracket rotatably attached to said housing, a propeller driven by a hydraulic motor at a lower end of said tube, a swivel union at an end of said tube opposite said hydraulic motor, said swivel union comprising a swivel union stationary section rotatably attached to a swivel union rotating section, means to prevent said swivel union stationary section from rotating relative to said housing, said swivel union rotating section being rigidly attached to said tube, a thruster angle indicator in said instrument panel, electronic angle detection means in said swivel union to determine and transmit to said thruster angle indicator via electrical signal an angle between said swivel union stationary section and said swivel union rotating section, and a thruster angle wire electrically connecting said electronic angle detection means and said thruster angle indicator, whereby said thruster angle indicator in said instrument panel displays a thrust angle of said thruster.

10. A modular hydraulic thruster system for vessel comprising a hydraulic power pack electrically connected to an instrument panel and hydraulically connected to at least one thruster; said thruster comprising a tube slidably disposed within a housing, a bracket rotatably attached to said housing, a propeller driven by a hydraulic motor at a lower end of said tube, a swivel union at an end of said tube opposite said hydraulic motor, said swivel union comprising a swivel union stationary section rotatably attached to a swivel union rotating section, means to prevent said swivel union stationary section from rotating relative to said housing, said swivel union rotating section being rigidly attached to said tube, a steering motor rigidly attached to said housing, a steering motor gear attached to a steering motor output, said steering motor gear engaging a tube gear rigidly attached to a tube gear clamp around said tube, tube gear clamp OPEN/CLOSED status indication means in said tube gear clamp, a tube gear clamp status indicator in said instrument panel, and a tube gear clamp wire electrically connecting said tube gear clamp OPEN/CLOSED status indication means to said tube gear clamp status indicator, a first length of said tube gear clamp wire electrically connecting said a tube gear clamp status indicator to a terminal on said swivel connector stationary section, a second length of said tube gear clamp wire electrically connecting a corresponding terminal on said swivel union rotating section with said tube gear clamp OPEN/CLOSED status indication means, said second length of tube gear clamp wire being at least partially disposed within said tube.

11. The modular hydraulic thruster system for vessel of claim 10 further comprising a flexible spiral conduit sized to slidably encircle said tube between said housing and said swivel union, and a tube aperture in an end of said tube which is attached to said swivel union rotating section, said second length of tube gear clamp wire running from said swivel union rotating section, through an inside of said tube, out of said tube through said tube aperture, through said flexible spiral conduit, and to said tube gear clamp status indicator.

12. A modular hydraulic thruster system for vessel comprising a hydraulic power pack electrically connected to an instrument panel and hydraulically connected to at least one thruster; said thruster comprising a tube slidably disposed within a housing, a bracket rotatably attached to said housing, a propeller driven by a hydraulic motor at a lower end of said tube, a swivel union at an end of said tube opposite said hydraulic motor, said swivel union comprising a swivel union stationary section rotatably attached to a swivel union rotating section, means to prevent said swivel union stationary section from rotating relative to said housing, said swivel union rotating section being rigidly attached to said tube, a thruster angle indicator in said instrument panel, electronic angle detection means in said swivel union to determine and transmit to said thruster angle indicator via electrical signal an angle between said swivel union stationary section and said swivel union rotating section, and a thruster angle wire electrically connecting said electronic angle detection means and said thruster angle indicator, whereby said thruster angle indicator in said instrument panel displays a thrust angle of said thruster.

13. A modular hydraulic thruster system for vessel comprising a hydraulic power pack electrically connected to an instrument panel and hydraulically connected to at least one thruster; said thruster comprising a tube slidably disposed within a housing, a bracket rotatably attached to said housing, a propeller driven by a hydraulic motor at a lower end of said tube, a swivel union at an end of said tube opposite said hydraulic motor, said swivel union comprising a swivel union stationary section rotatably attached to a swivel union rotating section, means to prevent said swivel union stationary section from rotating relative to said housing, said swivel union rotating section being rigidly attached to said tube, revolutions per minute detection means connected to a shaft of said propeller, a tachometer in said instrument panel, and tachometer wire electrically connecting said revolutions per minute detection means with said tachometer, a first length of said tachometer wire electrically connecting said tachometer to a terminal on said swivel connector stationary section, a second length of said tachometer wire electrically connecting a corresponding terminal on said swivel union rotating section with said revolutions per minute detection means, said second length of tachometer wire being at least partially disposed within said tube.

14. A modular hydraulic thruster system for vessel comprising a hydraulic power pack electrically connected to an instrument panel and hydraulically connected to at least one thruster; said thruster comprising a tube slidably disposed within a housing, a bracket rotatably attached to said housing, a propeller driven by a hydraulic motor at a lower end of said tube, a swivel union at an end of said tube opposite said hydraulic motor, said swivel union comprising a swivel union stationary section rotatably attached to a swivel union rotating section, means to prevent said swivel union stationary section from rotating relative to said housing, said swivel union rotating section being rigidly attached to said tube, and at least one electrical wire passing through said swivel union, whereby continuity is maintained through said at least one electrical wire even when said tube rotates relative to said housing.

15. A modular hydraulic thruster system for vessel comprising a hydraulic power pack electrically connected to an instrument panel and hydraulically connected to at least one thruster; said thruster comprising a tube slidably disposed within a housing, a bracket rotatably attached to said housing, a propeller driven by a hydraulic motor at a lower end of said tube, a swivel union at an end of said tube opposite said hydraulic motor, said swivel union comprising a swivel union stationary section rotatably attached to a swivel union rotating section, means to prevent said swivel union stationary section from rotating relative to said housing, said swivel union rotating section being rigidly attached to said tube, a steering motor rigidly attached to said housing, a steering motor gear attached to a steering motor output, said steering motor gear engaging a tube gear rigidly attached to a tube gear clamp around said tube, tube gear clamp OPEN/CLOSED status indication means in said tube gear clamp, a tube gear clamp status indicator in said instrument panel, and a tube gear clamp wire electrically connecting said tube gear clamp OPEN/CLOSED status indication means to said tube gear clamp status indicator, a first length of said tube gear clamp wire electrically connecting said a tube gear clamp status indicator to a terminal on said swivel connector stationary section, a second length of said tube gear clamp wire electrically connecting a corresponding terminal on said swivel union rotating section with said tube gear clamp OPEN/CLOSED status indication means, said second length of tube gear clamp wire being at least partially disposed within said tube.

16. The modular hydraulic thruster system for vessel of claim 15 further comprising a flexible spiral conduit sized to slidably encircle said tube between said housing and said swivel union, and a tube aperture in an end of said tube which is attached to said swivel union rotating section, said second length of tube gear clamp wire running from said swivel union rotating section, through an inside of said tube, out of said tube through said tube aperture, through said flexible spiral conduit, and to said tube gear clamp status indicator.

17. The modular hydraulic thruster system for vessel of claim 16 further comprising first lengths of open clamp hydraulic line and close clamp hydraulic line attached to fittings on said swivel clamp stationary section; second lengths of open clamp hydraulic line and close clamp hydraulic line attached to corresponding respective fittings on said swivel clamp rotating section; said second lengths of open clamp hydraulic line and close clamp hydraulic line running from said swivel union rotating section, through an inside of said tube, out of said tube through said tube aperture, through said flexible spiral conduit, and to said tube gear clamp.

18. The modular hydraulic thruster system for vessel of claim 17 further comprising a thruster angle indicator in said instrument panel, electronic angle detection means in said swivel union to determine and transmit to said thruster angle indicator via electrical signal an angle between said swivel union stationary section and said swivel union rotating section, and a thruster angle wire electrically connecting said electronic angle detection means and said thruster angle indicator, whereby said thruster angle indicator in said instrument panel displays a thrust angle of said thruster.

19. The modular hydraulic thruster system for vessel of claim 18 comprising first lengths of forward thrust hydraulic line, reverse thrust hydraulic line, and tachometer wire being attached to connectors on said swivel union stationary section; and second lengths of forward thrust hydraulic line, reverse thrust hydraulic line, and tachometer wire being attached to corresponding respective said terminals on said swivel union rotating section, said second lengths of forward thrust hydraulic line, reverse thrust hydraulic line, and tachometer wire running through an inside of said tube from said swivel union rotating section to said hydraulic motor.

20. The modular hydraulic thruster system for vessel of claim 17 wherein said tube gear clamp is a hydraulically-actuated clamp whose actuation means is a hydraulic tube gear clamp actuator, and wherein said second lengths of open clamp hydraulic line and close clamp hydraulic line run from said swivel union rotating section, through an inside of said tube, out of said tube through said tube aperture, through said flexible spiral conduit, and to said tube gear clamp actuator.

21. The modular hydraulic thruster system for vessel of claim 20 wherein said tube gear clamp OPEN/CLOSED status indication means is disposed in said tube gear clamp actuator.

22. A modular hydraulic thruster system for vessel comprising a hydraulic power pack electrically connected to an instrument panel and hydraulically connected to at least one thruster; said thruster comprising a tube slidably disposed within a housing, a bracket rotatably attached to said housing, a propeller driven by a hydraulic motor at a lower end of said tube, a swivel union at an end of said tube opposite said hydraulic motor, said swivel union comprising a swivel union stationary section rotatably attached to a swivel union rotating section, means to prevent said swivel union stationary section from rotating relative to said housing, said swivel union rotating section being rigidly attached to said tube, said means to prevent said swivel union stationary section from rotating relative to said housing comprising an anti-rotation member rigidly attached at one end to said swivel union stationary section and at least one anti-rotation guide rigidly attached to said housing, each said anti-rotating guide being sized to slidably admit said anti-rotation member, said anti-rotation member being disposed substantially parallel to said tube.

* * * * *